US005145634A

United States Patent [19]

Hintzen

[11] Patent Number: 5,145,634

[45] Date of Patent: Sep. 8, 1992

[54] CLOSING OR REGULATING APPARATUS FOR A METALLURGICAL VESSEL

[75] Inventor: Ullrich Hintzen, Taunusstein-Watzhahn, Fed. Rep. of Germany

[73] Assignee: Didier-Werke AG, Wiesbaden, Fed. Rep. of Germany

[21] Appl. No.: 631,058

[22] Filed: Dec. 19, 1990

[30] Foreign Application Priority Data

Jan. 17, 1990 [DE] Fed. Rep. of Germany ..... 4001095

[51] Int. Cl.[5] ..... B22D 41/08

[52] U.S. Cl. ..... 266/236; 222/598; 222/599

[58] Field of Search ..... 266/236; 222/597, 598, 222/599, 602

[56] References Cited

U.S. PATENT DOCUMENTS

| | | | |
|---|---|---|---|
| 2,224,514 | 12/1940 | Jung | 222/599 |
| 3,511,471 | 5/1970 | Rossi | 222/598 |
| 4,840,295 | 6/1989 | Hartley | 222/598 |
| 5,025,961 | 6/1991 | Hintzen et al. | 222/599 |

FOREIGN PATENT DOCUMENTS

| | | |
|---|---|---|
| 3731600A1 | 6/1989 | Fed. Rep. of Germany . |
| 420498 | 3/1967 | Switzerland . |

*Primary Examiner*—S. Kastler

*Attorney, Agent, or Firm*—Wenderoth, Lind & Ponack

[57] ABSTRACT

An apparatus for closing and/or regulating the discharge or tapping of molten metal from a metallurgical vessel includes a refractory outer pipe member having therethrough a discharge passage defining outer and inner openings and a refractory inner pipe member positioned within the outer pipe member, the inner pipe member having therethrough a passage defining outer and inner openings. A first of the pipe members is movable with respect to a second of the pipe members between open and closed positions. In the opened position, the discharge passages of the pipe members are aligned to define a molten metal discharge channel for passage therethrough in a flow direction of molten metal from an inlet opening to an outlet opening of the discharge channel. The cross-sectional area of the discharge channel is a minimum at the inlet opening and is increased between the inlet opening and the outlet opening.

20 Claims, 2 Drawing Sheets

CLOSING OR REGULATING APPARATUS FOR A METALLURGICAL VESSEL

BACKGROUND OF THE INVENTION

The present invention relates to an apparatus for closing and/or regulating the discharge or tapping of molten metal from a metallurgical vessel. More particularly, the present invention relates to such an apparatus including a refractory outer pipe member having therethrough a discharge passage defining outer and inner openings, and a refractory inner pipe member positioned within the outer pipe member, the inner pipe member having therethrough a discharge passage defining outer and inner openings. A first of the pipe members is movable, for example, rotatable or axially movable, with respect to a second of the pipe members between an opened position, whereat the discharge passages of the pipe members are aligned and with the inner opening of the outer pipe member confronting the outer opening of the inner pipe member, thereby defining a molten metal discharge channel that enables flow of molten metal through the pipe members in a flow direction from an inlet opening that receives molten metal from within the metallurgical vessel to an outlet opening to discharge the molten metal, and a closed position, whereat the discharge passages of the two pipe members are out of alignment and the inner opening of the outer pipe member and the outer opening of the inner pipe member are isolated from each other enclosed, thereby interrupting the discharge channel.

A closing and/or regulating apparatus of this general type is disclosed in German DE 37 31 600. In this type of device however, when the apparatus is in a closed position, molten metal will fill the discharge passage or passages through the outer pipe member but will not flow since the apparatus is closed. This molten metal can solidify or partially solidify within such discharge passage and form a solidified metal skin or small metal plug. Thereafter, when the movable pipe member is moved to the open position to open the apparatus, this frozen metal skin or metal plug can cause clogging of the molten metal discharge channel and prevent tapping of the molten metal. Thus, opening of the apparatus cannot be ensured 100 percent of the time, and this is an operational disadvantage.

In U.S. Pat. No. 3,511,471 there is disclosed a rotary slide gate or sliding closure unit having through various members discharge passages than can be aligned to form a discharge channel. The inlet opening to this discharge channel converges in a downstream direction. The result is that when the slide gate is in a closed position, a metal skin or metal plug that will form in the inlet discharge passage cannot be discharged with certainty upon subsequent opening of the apparatus. This is true even though this known slide gate discloses the downstream portions of the discharge channel diverge in a downstream direction.

Swiss Patent CH-PS 420,498 discloses a discharge apparatus where the relative position of a casting stream is changed by moving one member that partially forms a discharge channel. In this case, at least portions of the discharge channel converge in a downstream direction, and the above problem also occurs.

SUMMARY OF THE INVENTION

With the above discussion in mind, it is an object of the present invention to provide an improved apparatus for closing and/or regulating the discharge or tapping of molten metal from a metallurgical vessel, whereby it is possible to overcome the above and other prior art disadvantages. It is a more particular object of the present invention to provide such an apparatus whereby it is possible to ensure that when the apparatus is moved from a closed position to an open position, any solidified metal skin or metal plug formed in a discharge passage of an outer pipe member automatically and positively will be discharged in a downstream direction through the discharge channel.

It is a further object of the present invention to provide inner and outer pipe members employable in such a closing and/or regulating apparatus.

The above objects are achieved in accordance with the present invention by the provision that the flow cross section of the discharge channel is expanded from the inlet opening thereof to the outlet opening thereof. In other words, the cross-sectional area of the discharge channel is at a minimum at the inlet opening and increases between the inlet opening and the outlet opening.

As a result of this structural arrangement, when the apparatus is in a closed position with molten metal in the metallurgical vessel, then molten metal that freezes in the discharge passage in the outer pipe member automatically will be expelled through the discharge channel without causing clogging thereof upon subsequent opening of the apparatus. More specifically, the molten metal can be allowed to freeze to form a metal skin or metal plug within the discharge passage in the outer pipe member, in the region of the inlet opening and optionally as far as the inner opening thereof. When the apparatus subsequently is opened, then due to the fact that the cross-sectional area of the discharge channel is expanded in the downstream direction, the pressure of the molten metal within the metallurgical vessel will push any solidified metal skin or metal plug in the flow direction through the discharge channel and outwardly of the outlet opening thereof. Thereby, it is possible to ensure that the apparatus of the present invention will enable, 100 percent of the time, opening of the apparatus and immediate tapping of the molten metal therethrough.

In accordance with one embodiment of the present invention, the outer pipe member is a stator of the apparatus, and the inner pipe member is a rotor of the apparatus. Thus, the inlet opening of the discharge channel comprises the outer opening of the outer pipe member, and the outlet opening of the discharge channel comprises the inner opening of the inner pipe member.

In accordance with one feature of the present invention, the cross-sectional area of the discharge passage through the outer pipe member increases from the outer opening thereof to the inner opening thereof, and in a particular embodiment, this increase is conically from the outer opening to the inner opening. Similarly, the cross-sectional area of the discharge passage in the inner pipe member can increase from the outer opening thereof to the inner opening thereof, and this increase may be conically from the outer opening to the inner opening. It is possible however to provide an arrangement whereby the increase occurs only in the discharge passage in the outer pipe member, with the cross-sectional area of the discharge passage in the inner pipe member being at least partially substantially the same as the cross-sectional area at the inner opening of the outer pipe member.

In accordance with a further arrangement of the present invention, the cross-sectional area of the discharge passage in the inner pipe member is at least partially greater than the cross-sectional area of the inner opening of the outer pipe member. The cross-sectional area of the discharge passage in the inner pipe member may increase from the outer opening thereof to the inner opening, and this increase can be conically.

In accordance with a further arrangement of the present invention, the cross-sectional configuration of the discharge passage in the outer pipe member is uniform from the outer opening thereof to the inner opening thereof. The cross-sectional area of the discharge passage in the inner pipe member may increase, for example conically, from the outer opening thereof to the inner opening thereof. Further, the cross-sectional area of the discharge passage in the inner pipe member may be greater than the cross-sectional area of the discharge passage in the outer pipe member, and the cross-sectional configuration of the discharge passage in the inner pipe member may be uniform from the outer opening thereof to the inner opening thereof. This cross-sectional configuration of the discharge passage of the inner pipe member may be circular or non-circular, for example oval. Further, the axial centers of the discharge passages in the inner and outer pipe members may be coincident or not coincident. When not coincident, the axial center line of the discharge passage in the outer pipe member may be at a level lower than the axial center of the discharge passage in the inner pipe member.

In accordance with a further feature of the present invention, the cross-sectional area of the discharge channel increases stepwise, and this stepwise increase may be achieved by providing that the outer opening of the inner pipe member is larger than the inner opening of the outer pipe member. This arrangement facilitates the discharge of any frozen metal in the discharge passage of the outer pipe member into the larger discharge passage in the inner pipe member. Such stepwise increase additionally can be provided in the discharge channel of the outer pipe member or in the discharge channel of the inner pipe member. Even further, plural stepwise increases may be achieved in and/or between the discharge passages in the inner and/or outer pipe members.

BRIEF DESCRIPTION OF THE DRAWINGS

Other objects, features and advantages of the present invention will be apparent from the following detailed description, with reference to the accompanying drawings, wherein.

DETAILED DESCRIPTION OF THE INVENTION

Figure 1:
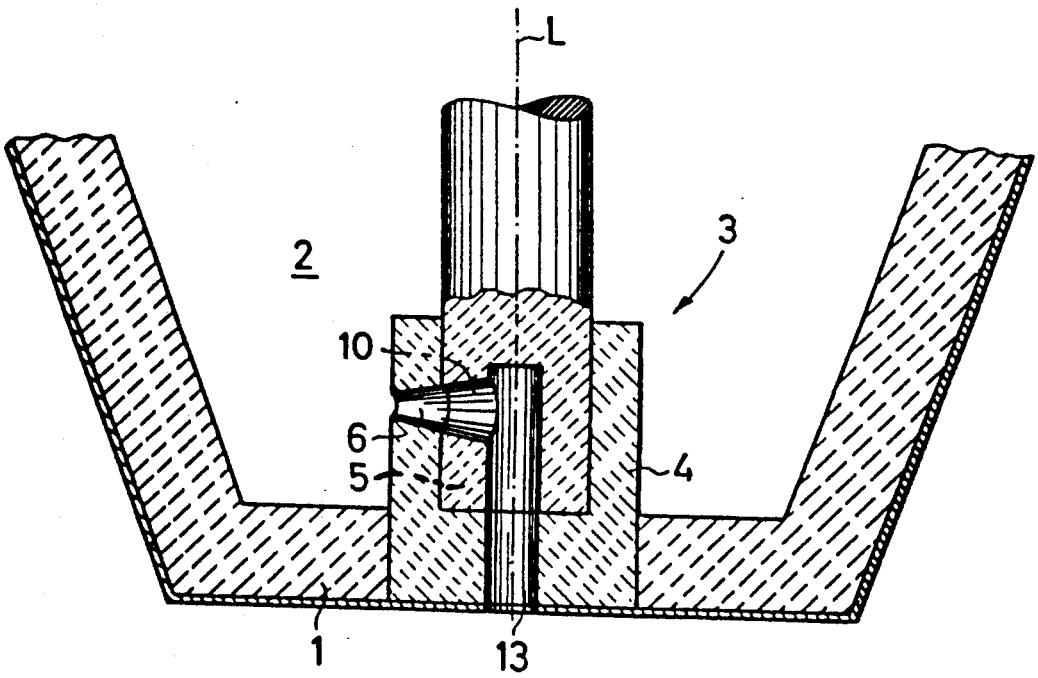
FIG. 1 is a sectional view through the bottom of a metallurgical vessel incorporating a closing and/or regulating apparatus in accordance with one embodiment of the present invention.

In FIG. 1 there is illustrated schematically a lower portion of a metallurgical vessel including a bottom 1 with a refractory lining and equipped with a closing and/or regulating apparatus 3 according to one embodiment of the present invention. Molten metal is intended to be filled into an interior 2 of the metallurgical vessel.

The apparatus 3 includes a refractory ceramic outer pipe member 4 having positioned therein a refractory ceramic inner pipe member 5. Outer pipe member 4 is sealingly mounted within the bottom of the metallurgical vessel and thus forms a stator of the apparatus. Inner pipe member 5 is rotatable within outer pipe member 4 around a common longitudinal axis L of pipe members 4, 5. Inner pipe member 5 fits within an axial recess within outer pipe member 5. Inner pipe member 5 and outer pipe member 4 have communicating internal channels that axially align to form an outlet passage 13.

Figure 2:
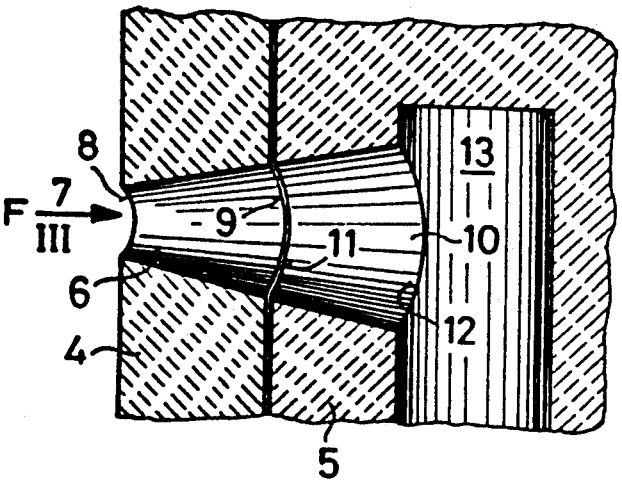
FIG. 2 is an enlarged sectional view illustrating the configuration of discharge passages forming a discharge channel in such apparatus.

With particular reference to FIG. 2, outer pipe member 4 has therethrough a discharge passage 6 defining an outer opening 8 and an inner opening 9. Similarly, inner pipe member 5 has therethrough a discharge passage 10 defining an outer opening 11 and an inner opening 12. Inner pipe member 5 is rotatable relative to outer pipe member 4 about axis L to be moved between open and closed positions. At the open position, shown in FIGS. 1 and 2, discharge passages 6, 10 are aligned with each other with inner opening 9 of outer pipe member 4 confronting outer opening 11 of inner pipe member 5. This thereby defines a molten metal discharge channel 7 enabling flow of molten metal through the pipe members in a flow direction F from an inlet opening of the discharge channel formed by outer opening 8 in outer pipe member 4 to an outlet opening of the discharge channel formed by inner opening 12 of inner pipe member 5. In a closed position, not illustrated, discharge passages 6, 10 are out of alignment, and inner opening 9 of outer pipe member 4 and outer opening 11 of inner pipe member 5 are isolated from each other and closed, thereby interrupting the discharge channel and the flow of molten metal therethrough.

When the inner pipe member 5 is moved to the closed position, then an outer peripheral surface of inner pipe member 5 will close opening 9. As a result, when molten metal is within interior 2 of the metallurgical vessel, such molten metal will enter discharge passage 6 and can solidify therein. In accordance with the present invention, the flow cross section of the discharge channel formed by discharge passages 6, 10 expands in the flow direction F of the molten metal. More particularly, the cross-sectional area of discharge channel 7 is a minimum at the inlet opening 8 and increases between inlet opening 8 and outlet opening 12. In the particular arrangement of the embodiment of FIGS. 1-2, the cross-sectional area of discharge passage 6 increases from opening 8 to opening 9, and this increase is conically. Similarly, the cross-sectional area of discharge passage 10 increases from opening 11 to opening 12, and this increase is conically. As a result, when inner pipe member 5 is rotated to the open position to align passages 6, 10, then any solidified metal within discharge passage 6 will be conveyed by the pressure of molten metal within the interior of the metallurgical vessel to pass into and through discharge passage 10 and into outlet channel 13. This specifically is due to the provision of the increase or expanded flow cross section of the discharge channel 7 from the inlet opening 8 thereof to the outlet opening 12 thereof. This solves a significant prior art problem. This problem particularly occurs with the apparatus in the closed position and when initially filling molten metal into the interior of the metallurgical vessel. The various elements of the apparatus and metallurgical vessel then are at their coolest temperature, with the greatest possibility of molten metal solidifying within the blocked discharge passage 6. When the apparatus subsequently is moved to its open position for teeming of the metal through the apparatus, any solidified metal skin or plug automatically and quickly is discharged through the remainder of channel 7 and into channel 13. The pressure of the molten metal in the metallurgical vessel is sufficient to ensure this operation, and this is done quickly and surely without the metal skin or plug blocking the channel.

Figure 3:
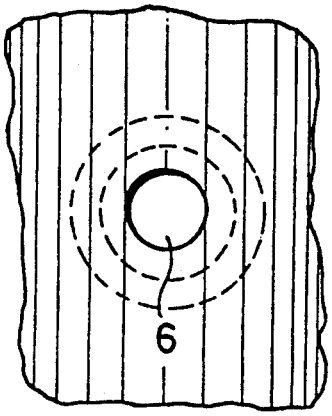
FIG. 3 is an end view from the direction of arrow III in FIG. 2.
Figure 4:
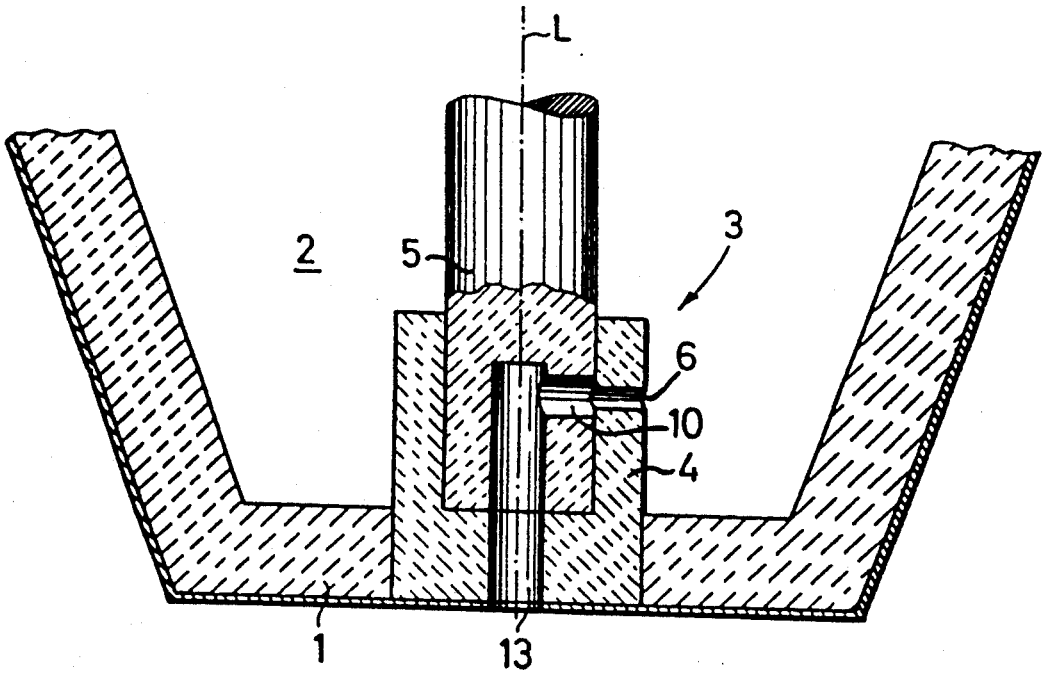
FIG. 4 is a view similar to FIG. 1 but of another embodiment of the present invention.

In the embodiment of FIGS. 1–3, discharge passage 6 expands conically, and discharge passage 10 also expands conically at the same conical angle and continuing the conical expansion of discharge passage 6. The opening 9 of outer pipe member 4 is approximately the same as the opening 11 of inner pipe member 5, but as would be understood by one skilled in the art could be negligibly or minutely larger.

In the embodiments of FIGS. 4–8, the discharge channel 7 is expanded stepwise. This is achieved by providing that the outer opening of the inner pipe member is larger than the inner opening of the outer pipe member. Particularly, discharge passage 6 is illustrated as having a uniform cross-sectional configuration between openings 8 and 9, and particularly a circular-cylindrical cross-sectional configuration.

Figure 6:
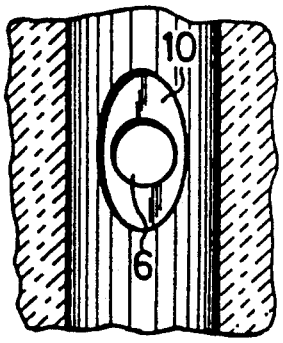
FIG. 6 is an end view in the direction of arrow VI in FIG. 5.
Figure 5:
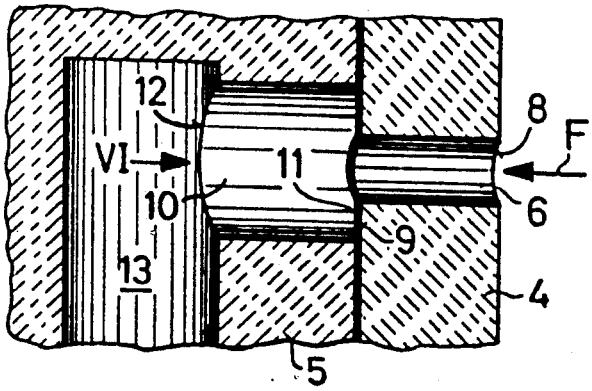
FIG. 5 is an enlarged view similar to FIG. 2 but of those portions of the arrangement of the embodiment of FIG. 4 forming a discharge channel therein.

In the embodiment of FIGS. 5 and 6, the discharge passage 10 in inner pipe member 5 is uniform between openings 11, 12 and is of oval configuration, with the longer axis of the oval cross-section extending parallel to longitudinal axis L. The center axes of the discharge passages 6, 10 are not coincident, i.e. they are staggered vertically as shown in FIGS. 5 and 6. Particularly, the axial center of discharge passage 6 is vertically lower than the axial center of discharge passage 10.

Figure 8:
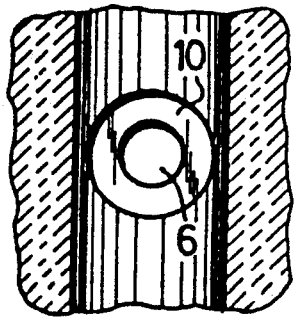
FIG. 8 is an end view in the direction of arrow VIII in FIG. 7.
Figure 7:
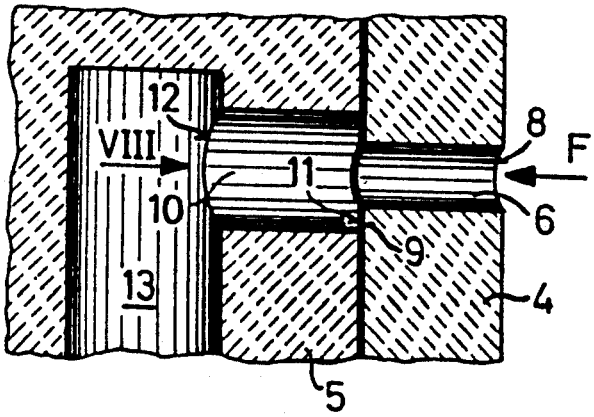
FIG. 7 is a view similar to FIG. 5 but of a modification thereof.

In the embodiment of FIGS. 7 and 8, discharge passage 10 also is of circular-cylindrical configuration. In this embodiment, the axial centers of discharge passages 6, 10 are coincident, but could be not coincident.

In the embodiments of FIGS. 4–8, the cross-sectional area of the discharge channel 7 is expanded dramatically between passage 6 and passage 10. Thus, any molten metal that tends to solidify in outer passage 6 when the apparatus is in the closed position easily will be discharged into the abruptly larger cross-sectional area of discharge passage 10 when the apparatus subsequently is opened.

It is to be understood that various combinations of the features described in the above embodiments may be combined as would be apparent to one skilled in the art. It furthermore is to be understood that other possible configurations incorporating the basic concept of the present invention are possible. For example, it would be possible to provide that discharge passage 6 is conical as shown in FIG. 2 and that the discharge passage 10 is cylindrical as in FIGS. 7 and 8 or oval as in FIGS. 5 and 6, with opening 9 being significantly smaller than opening 11. Other possible modifications of the specifically described and illustrated features will be apparent to one skilled in the art and are intended to be encompassed within the present invention without departing from the scope thereof.

I claim:

1. An apparatus for closing and/or regulating the discharge or tapping of molten metal from a metallurgical vessel, said apparatus comprising:

a refractory outer pipe member having therethrough a discharge passage defining outer and inner openings;

a refractory inner pipe member positioned within said outer pipe member, said inner pipe member having therethrough a discharge passage defining outer and inner openings;

a first said pipe member being movable with respect to a second said pipe member between an open position, whereat said discharge passages of said pipe members are aligned with said inner opening of said outer pipe member confronting said outer opening of said inner pipe member, thereby defining a molten metal discharge channel enabling flow of molten metal through said pipe members in a flow direction from an inlet opening to receive molten metal to an outlet opening to discharge molten metal, and a closed position, whereat said discharge passages of said pipe members are out of alignment and said inner opening of said outer pipe member and said outer opening of said inner pipe member are isolated and closed, thereby interrupting said discharge channel;

whereby, when said first pipe member is in said closed position, molten metal in said discharge passage of said outer pipe member may become solidified to form a solid metal plug; and means for ensuring that, when said first pipe member is moved from said closed position to said open position, any metal plug solidified in said discharge passage of said outer pipe member automatically and positively will be discharged in said flow direction through said discharge channel, said means comprising the cross-sectional area of said discharge channel being a minimum at said inlet opening and being increased between said inlet opening and said outlet opening.

2. An apparatus as claimed in claim 1, wherein said inlet opening comprises said outer opening of said outer pipe member, and said outlet opening comprises said inner opening of said inner pipe member.

3. An apparatus as claimed in claim 2, wherein the cross-sectional area of said discharge passage through said outer pipe member increases from said outer opening thereof to said inner opening thereof.

4. An apparatus as claimed in claim 3, wherein said cross-sectional area of said discharge passage in said outer pipe member increases conically from said outer opening thereof to said inner opening thereof.

5. An apparatus as claimed in claim 4, wherein the cross-sectional area of said discharge passage in said inner pipe member is at least partially substantially the same as said cross-sectional area at said inner opening of said outer pipe member.

6. An apparatus as claimed in claim 5, wherein said cross-sectional area of said discharge passage in said inner pipe member increases from said outer opening thereof to said inner opening thereof.

7. An apparatus as claimed in claim 6, wherein said cross-sectional area of said discharge passage in said inner pipe member increases conically from said outer opening thereof to said inner opening thereof.

8. An apparatus as claimed in claim 2, wherein the cross-sectional area of said discharge passage in said inner pipe member is at least partially greater than the cross-sectional area of said inner opening of said outer pipe member.

9. An apparatus as claimed in claim 8, wherein said cross-sectional area of said discharge passage in said inner pipe member increases from said outer opening thereof to said inner opening thereof.

10. An apparatus as claimed in claim 9, wherein said cross-sectional area of said discharge passage in said inner pipe member increases conically from said outer opening thereof to said inner opening thereof.

11. An apparatus as claimed in claim 2, wherein the cross-sectional configuration of said discharge passage in said outer pipe member is uniform from said outer opening thereof to said inner opening thereof.

12. An apparatus as claimed in claim 11, wherein the cross-sectional area of said discharge passage in said inner pipe member is greater than the cross-sectional area of said discharge passage in said outer pipe member.

13. An apparatus as claimed in claim 12, wherein the cross-sectional configuration of said discharge passage in said inner pipe member is uniform from said outer opening thereof to said inner opening thereof.

14. An apparatus as claimed in claim 13, wherein said cross-sectional configuration of said discharge passage in said inner pipe member is circular.

15. An apparatus as claimed in claim 13, wherein said cross-sectional configuration of said discharge passage in said inner pipe member is oval.

16. An apparatus as claimed in claim 12, wherein axial centers of said discharge passages in said inner and outer pipe members are not coincident.

17. An apparatus as claimed in claim 16, wherein said axial center of said discharge passage in said outer pipe member is lower than said axial center of said discharge passage in said inner pipe member.

18. An apparatus as claimed in claim 12, wherein axial centers of said discharge passages in said inner and outer pipe members are coincident.

19. An apparatus as claimed in claim 2, wherein said cross-sectional area of said discharge channel increases stepwise.

20. An apparatus as claimed in claim 19, wherein said stepwise increase is due to said outer opening of said inner pipe member being larger than said inner opening of said outer pipe member.

* * * * *